US005165322A

United States Patent [19]

Moody

[11] Patent Number: 5,165,322

[45] Date of Patent: Nov. 24, 1992

[54] THREE POSITION POWER CYLINDER

[75] Inventor: Paul E. Moody, Barrington, R.I.

[73] Assignee: The United States of America as represented by the Secretary of the Navy, Washington, D.C.

[21] Appl. No.: 902,262

[22] Filed: Jun. 22, 1992

[51] Int. Cl.[5] ..... F01B 7/10

[52] U.S. Cl. ..... 92/65; 92/166; 92/130 R; 92/DIG. 4

[58] Field of Search ..... 92/62, 61, 65, 166, 92/130 R, 151, DIG. 4

[56] References Cited

U.S. PATENT DOCUMENTS

| | | | |
|---|---|---|---|
| 2,472,236 | 6/1949 | Thomas | 92/62 |
| 2,764,131 | 9/1956 | Knights | 92/62 |
| 2,831,464 | 4/1958 | Lillquist | 92/62 |
| 3,499,369 | 3/1970 | Joseph | 92/65 |
| 5,012,725 | 5/1991 | Leary | 92/65 |
| 5,125,326 | 6/1992 | Sarcona | 92/62 |

FOREIGN PATENT DOCUMENTS

| | | | |
|---|---|---|---|
| 2077856 | 12/1981 | United Kingdom | 92/62 |

*Primary Examiner*—Thomas E. Denion
*Attorney, Agent, or Firm*—Michael J. McGowan; Prithvi C. Lall; Michael F. Oglo

[57] ABSTRACT

An assembly for moving objects by mechanical linkages has a power cylinder with a shoulder at the juncture of a small bore and a large bore and with ports adjacent each end and one adjacent the shoulder. A shaft extends through the cylinder with a larger diameter portion in the smaller bore with a piston thereon sealing against the surface of the smaller bore. A second piston slidably seals on the small diameter of the shaft and against the larger bore, being biased towards the shoulder by a spring. A lost motion device on the end of the shaft projects outwardly of the smaller bore end of the power cylinder and has a housing with a chamber in which the end of the shaft is slidable against a spring which biases it outwardly of the housing. Pressurized fluid when supplied to the ports in the large portion of the power cylinder moves the shaft within the lost motion device against the spring to move the lost motion device, and when supplied to the ports at the ends of the power cylinder, permits the spring of the lost motion device to bias the piston shaft in the direction of the large bore. When supplied only to the port in the smaller diameter bore, the shoulder on the piston shaft will move the slidable piston against its spring and the piston shaft is moved still further in the direction of the large bore. When a pair of positioning members is attached to opposite sides of the lost motion device, the assembly enables selective motion of both positioning members and additional motion of only the positioning member attached to the shaft before the lost motion device.

11 Claims, 3 Drawing Sheets

THREE POSITION POWER CYLINDER

STATEMENT OF GOVERNMENT INTEREST

The invention described herein may be manufactured and used by or for the Government of the United States of American for governmental purposes without the payment of any royalties thereon or therefor.

BACKGROUND OF THE INVENTION

Field of the Invention

The present invention relates to power cylinders for imparting motion to objects and, more particularly, to a power cylinder which has three stable positions for effecting varying degrees of motion of objects which are connected to it.

Hydraulic mechanisms for moving various objects between a number of positions are old and well known. Frequently, they are used in multiples when it is desired to move two or more separate objects through differing lengths of travel.

In some instances, it may be desirable first to effect a limited motion of one object and then to effect concurrent movement of two objects. To achieve such results, it is frequently necessary to utilize a pair of mechanisms operated concurrently or in tandem to effect the desired motion of the individual objects. Providing dual mechanisms to effect concurrent motion of a pair of objects obviously requires duplication of the power assemblies and concomitant use of space as well as added power and control requirements.

In some structures, it is desirable to have inner and outer doors which are to be moved between open and closed positions, with one of those doors desirably being able to be moved into a partially open position when required. This may present problems when the doors o other operating elements to be moved by the power cylinder assemblies must act against substantial pressures or when the drive path to, or the location of, the objects being controlled provides only limited space for the power cylinder assemblies.

SUMMARY OF THE INVENTION

It is an object of the present invention to provide a novel power cylinder assembly providing three stable positions to effect motion of objects connected thereto through suitable mechanical linkages.

It is also an object to provide such a power cylinder assembly which will reliably effect operation of a pair of objects jointly to extreme positions and of one of the objects to an intermediate position.

Another object is to provide such a power cylinder assembly which may be fabricated readily, which is reasonably compact, and which will exhibit relatively long lived operation.

It has now been found that the foregoing and related objects may be readily attained in a three position power cylinder assembly for effecting motion of objects through mechanical linkages comprising elongated power cylinder having a shoulder therein defined by the juncture of a smaller bore at one end and a larger diameter bore at the other end and having ports thereinto adjacent each end and adjacent the shoulder. A shaft extends axially outwardly of both ends of the power cylinder and it has a larger diameter portion in the smaller bore with a piston collar fixedly positioned thereon sealing against the surface of the smaller bore. A second piston is slidable on the smaller diameter portion of the shaft and closely seals against the surface of the larger bore and shaft, and a resiliently compressible means biases the slidable piston towards the shoulder. A lost motion device is provided on the end of the shaft projecting outwardly of the smaller bore end of the cylinder, and it has a housing providing a chamber in which the end of the piston shaft is slidably received, and resiliently compressible means in the chamber biasing the power cylinder shaft outwardly of the housing. A pair of positioning elements may be coupled to the assembly on either side of the lost motion device.

When pressurized fluid is supplied to the ports in the larger bore of the power cylinder, the power cylinder shaft is moved within the chamber of the lost motion device against the biasing pressure of the compressible means to move the lost motion device with the power cylinder shaft and thereby both positioning elements are moved to one end position of their travel. When pressurized fluid is supplied to the ports at the ends of the power cylinder, the compressible means of the lost motion device biases the power cylinder shaft axially in the lost motion device in the direction of the larger bore and moves only the associated positioning element between the power cylinder and lost motion device in the opposite direction. When pressurized fluid is supplied only to the port in the smaller bore, the shoulder of the power cylinder shaft moves the slidable piston against its compressible means, and the power cylinder shaft is moved still further in the direction of the larger bore to move both positioning elements to the opposite end position of their travel.

Preferably, the resiliently compressible means comprise helical compression springs, and the lost motion device includes an axial stub post in the chamber of the housing against which the end of the power cylinder shaft bears. The end portion of the power cylinder shaft within the chamber has a collar spaced inwardly from its end, and the spring has its ends seated on the stub post and the end of the power cylinder and bears against the end wall and collar. The slidable piston has a washer on its face against which the shoulder of the power cylinder shaft abuts.

Desirably, the end wall of the larger bore of the power cylinder has an annular boss and the opposing face of the slidable piston has a reduced diameter neck, and the helical spring has it sends seated thereon. Sealing elements are provided in the end walls of the power cylinder about the power cylinder shaft.

BRIEF DESCRIPTION OF THE DRAWINGS

Other objects, features and advantages of the present invention will become apparent upon embodiments and to the drawings, wherein.

DESCRIPTION OF THE PREFERRED EMBODIMENT

Figure 1:
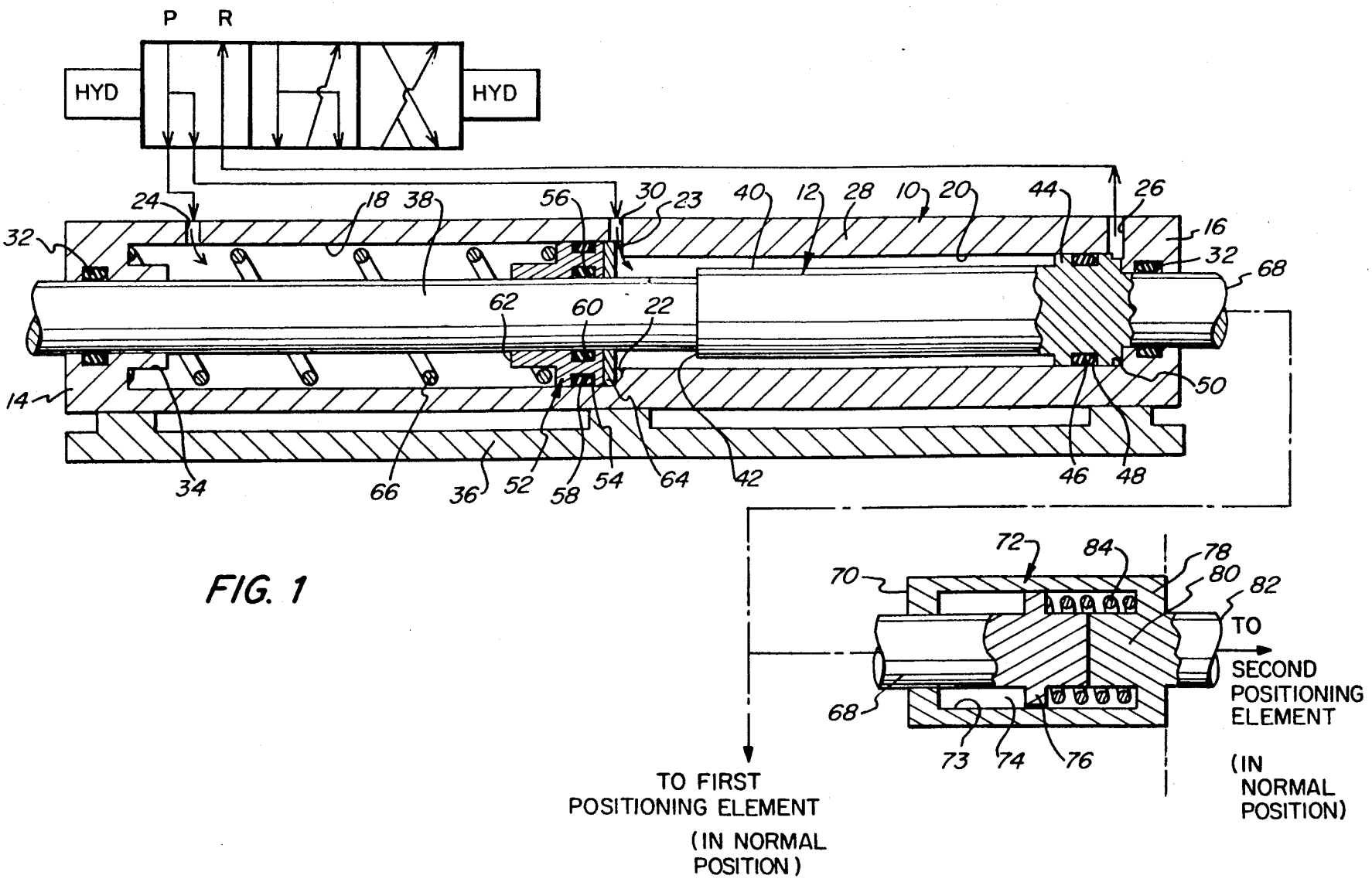
FIG. 1 is a fragmentary sectional view of a power cylinder assembly embodying the present invention schematically showing linkages to a pair of positioning elements and further schematically showing the hydraulic control in a position to effect motion of the positioning elements controlled thereby into a normal position.

Referring now to FIG. 1, a power cylinder assembly embodying the present invention has been shown. The assembly includes an elongated power cylinder generally designated by the numeral 10 with an elongated shaft generally designated by the numeral 12 extending through end walls 14 and 16 thereof. The circular bore of the cylinder 10 has a larger diameter portion 18 adjacent one end and a smaller diameter portion 20 adjacent the other end with the shoulder 22 therebetween facing end wall 14. The portion 23 of the shoulder 22 adjacent the sidewall 28 is inclined in the direction of the end wall 14.

Ports 24 and 26 ar ®provided in sidewall 28 adjacent end walls 14 and 16, and port 30 is provided in the sidewall 28 of large diameter bore 18 adjacent shoulder 22. Seals 32 are provided in end walls 14 and 16 for slidably sealing about shaft 12. End wall 14 has an axially extending annular boss 34 on its inside surface for a purpose to be described hereinafter. Cylinder 10 is shown supported on a mounting bracket 36 for mounting it upon a suitable support surface (not shown).

Shaft 12 has a smaller diameter portion 38 extending through the end wall 14 and large diameter bore 18 into small diameter bore 20, and a larger diameter portion 40 extending through smaller diameter bore 20. A radial shoulder 42 is formed between the two shaft portions 38 and 40. The larger diameter portion 40 of shaft 12 has a piston 44 fixedly positioned thereon with a sealing element 46 seated in a circumferential groove 48 thereabout to effect sealing engagement with bore 20 of cylinder 10. Piston 44 also has a circumferential recess 50 about its face adjacent end wall 16.

Slidably seated on the smaller diameter portion 38 of shaft 12 within larger diameter bore 18 is a movable piston generally designated by the numeral 52, and it is of generally annular cross section. In its outer and inner peripheral surfaces are circumferential grooves 54 and 56, respectively, in which are seated sealing elements 58 and 60, respectively, which effect sealing with the surfaces of the shaft portion 38 and bore 18. Piston 52 also has an axially extending boss 62 on its face disposed oppositely from shoulder 42. Disposed on the face of the piston 52 adjacent shoulder 42 is a washer 64.

A helical compression spring 66 extends about smaller diameter portion 38 of shaft 12, and it has its ends seated around boss 34 and boss 62. As a result, piston 52 is biased towards shoulder 22 and abuts inclined surface 23.

As indicated, shaft 12 extends through end wall 16 of cylinder 10, and the projecting end portion 68 of shaft 12 extends through an end wall 70 of a lost motion device housing generally designated by the numeral 72 and into its chamber 74. Spaced from the lost motion device end of shaft 12 is a peripheral collar 76 which slidably seats against the bore 73 of housing 72. An end wall 78 has an internal axial boss 80 against which shaft 12 may abut, and a shaft 82 extends axially from the outer surface thereof. Shaft 82 and housing 72 are fixedly connected for concurrent motion. A helical compression spring 84 has one end seated over the end of the shaft 12, bearing against the collar 76, and its other end is seated around boss 80 and bears against end wall 78.

As indicated diagrammatically by the positioning of the components therein, in FIG. 1, shaft 12 physically positions a device in its normal position by a first positioning element. Shaft 82 of the lost motion device is connected to a second device through a second positioning element, and movement of shaft 12 which positions shaft 82 and the second device in its normal position.

In FIG. 1, hydraulic fluid is introduced into the power cylinder 10 through ports 24 and 30. This holds piston 52 against the shoulder 22 and moves piston 44 towards end wall 16. As a result, portion 68 of shaft 12 is moved in chamber 74 of lost motion housing 72 against the biasing pressure of the spring 84 and against the boss 80 to move the housing 72 and shaft 82. This movement of the shaft 12 and shaft 82 forces both devices connected to the assembly into their normal position.

Figure 2:
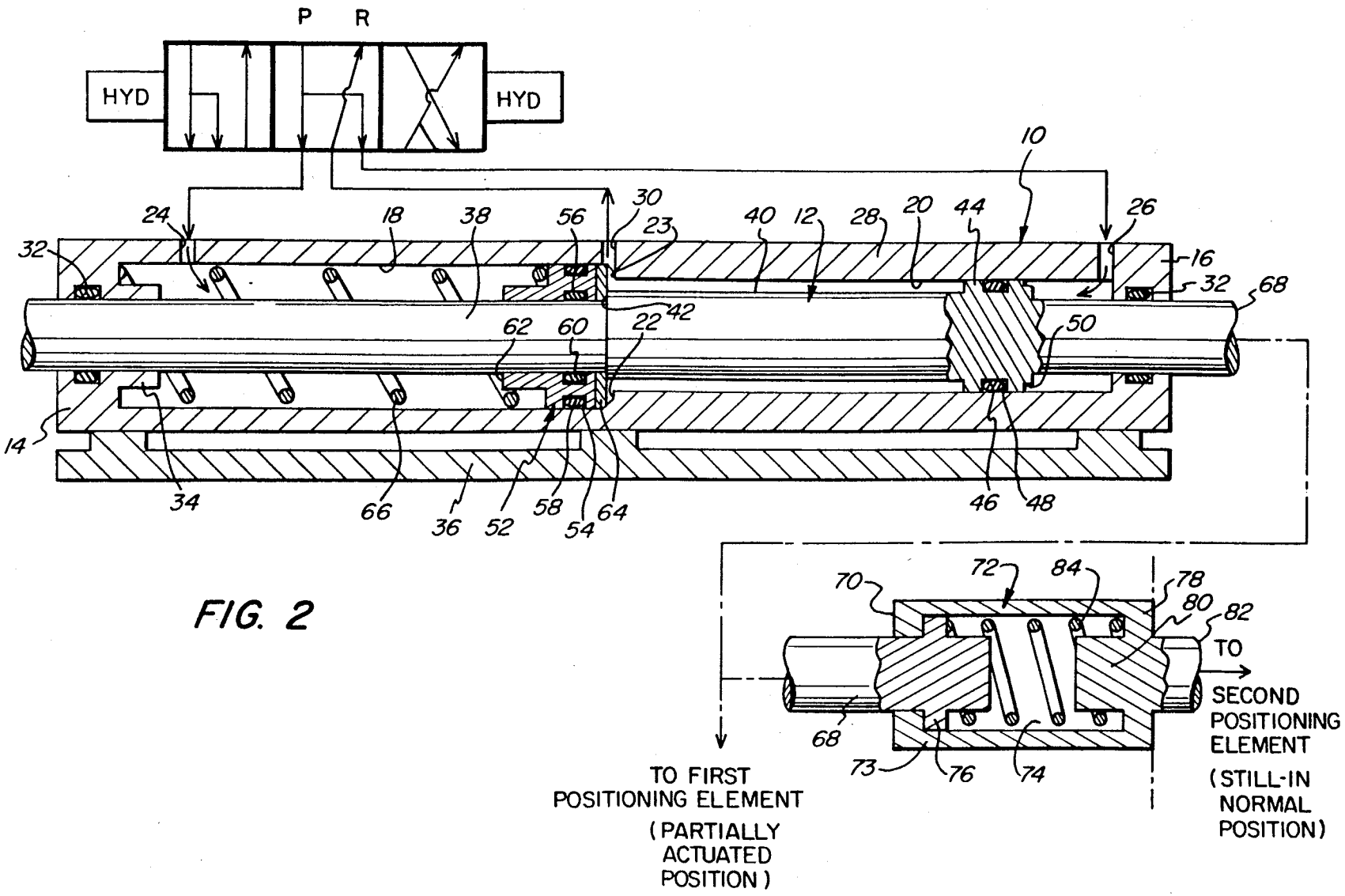
FIG. 2 is a similar view showing the hydraulic control in a position to move one of the positioning elements into a partially actuated position, while showing the second positioning element remaining in its normal position.

In FIG. 2, hydraulic fluid is introduced into the ports 24 and 26 to hold piston 52 against the shoulder 22 and to cause piston 44 to move shaft 12 a short distance towards end wall 14. Once shoulder 42 contacts washer 64, all motion will stop as hydraulic force in large bore 18 is greater than the counter force in small bore 20. The end portion 68 of shaft 12 is also moved away from the boss 80 in the lost motion device and against end wall 70. Shaft 82 and housing 72 of the lost motion device do not move. Therefore, the second positioning element and device remain in the normal position. However, the first positioning element and device are physically connected to the shaft 68. This limited movement of shaft 68 partially activates the first device, but does not affect the second device.

Figure 3:
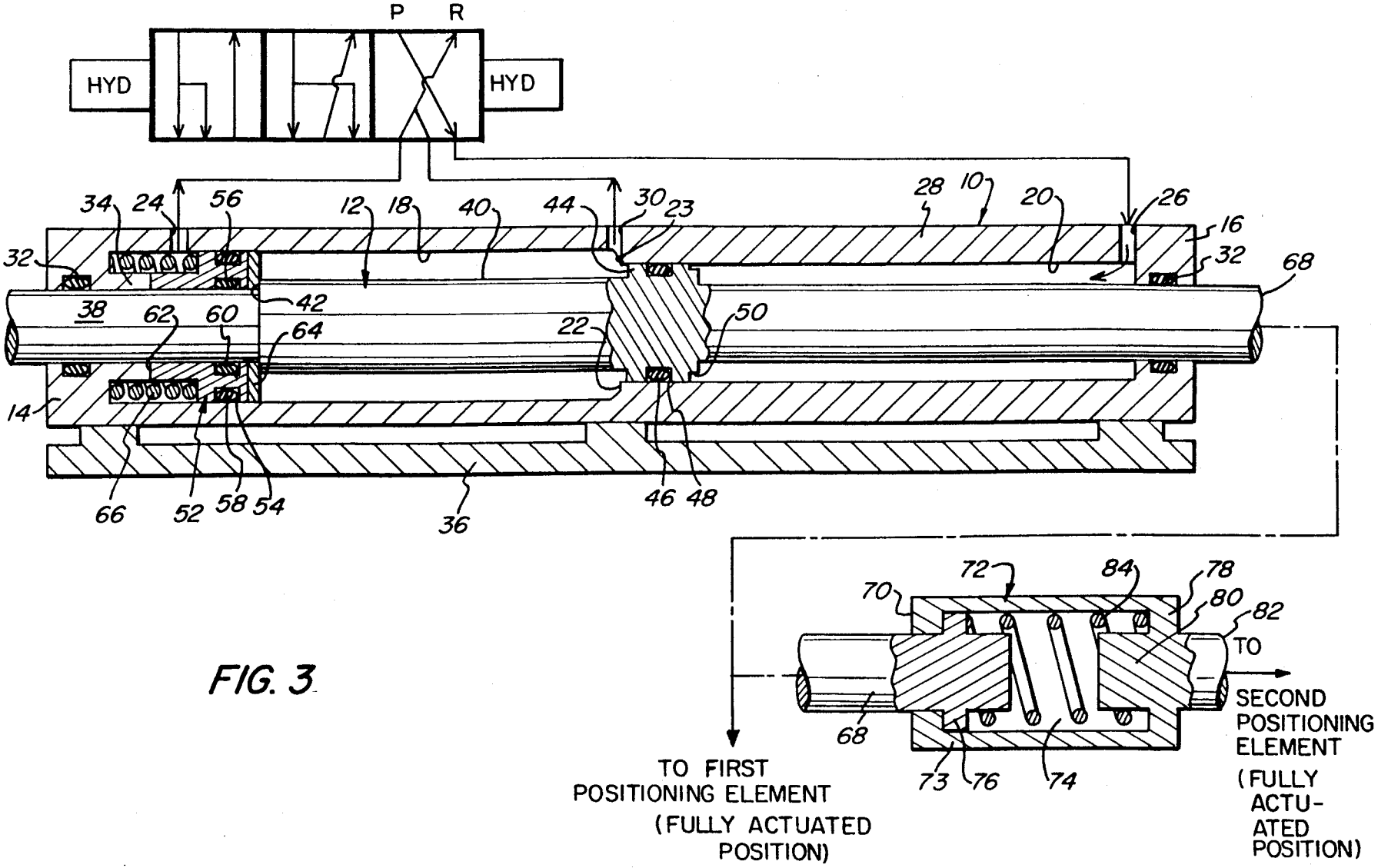
FIG. 3 is a similar view showing the hydraulic control in a position to effect full motion of both positioning elements into fully actuated positions, and showing the elements of the power cylinder assembly in the position effected thereby.

In FIG. 3, hydraulic fluid is introduced only through port 26 as pressure is now released from port 24. There is no longer sufficient force holding piston 52 in place. Therefore piston 44 moves further towards the end wall 14. As it moves, shoulder 42 abuts washer 64 and moves piston 52 against the biasing pressure of the spring 66 until it abuts boss 34. At the same time, collar 76 on the shaft end portion 68 bears against the end wall 70 of the housing 72 and moves the lost motion device. This extensive travel of shafts 12 and 82 fully actuates both the first and the second devices through their positioning elements to move and hold each of them to a second position.

Obviously many modifications and variations of the present invention may become apparent in view of the above techniques. For example:

As will be readily appreciated, the nature of the linkages to the structures which are being moved may vary considerably. For example, the shaft from the lost motion device may be directly connected to one object, and a second object may be directly connected to the extension portion of the operating piston shaft at a point prior to the lost motion device. However, intermediate linkages will generally provide greater versatility as to placement of the power cylinder assembly and may utilize elements to expand the extent of motion effected by the limited motion of the power cylinder shaft.

The hydraulic control mechanism for the power cylinder has only been schematically illustrated, but multiport control mechanisms of the type which may be employed herein are well known to persons having ordinary skill in the art and are readily coupleable to suitable manual controls to effect operation.

The dimensions of the power cylinder assembly obviously may be readily varied depending upon the application. Also, although coiled compression springs have been utilized to effect the biasing action on the movable piston and on the collar within the lost motion device housing, it will be readily appreciated that other mechanisms may be employed to achieve the same result. For example, a hydraulic fluid may be utilized in the lost motion device housing to provide a biasing pressure on the collar of the shaft. In addition, seals 32, 46, 58, and 60, while generally of the elastomeric type known as 'O' rings, may be of any well known material or shape suitable for sealing shafts and pistons in power cylinders.

The types of devices to which the power cylinder assembly of the present invention may be coupled vary widely. The preferred applications are those wherein two objects are desired to be moved concurrently in two directions of motion between two positions, and it is desired for one of the objects to have an intermediate position.

Thus, it can be seen from the foregoing detailed specification and the attached drawings that the power cylinder assembly of the present invention is one which may be readily fabricated and which provides three stable positions for its operating components. As a result, a pair of devices operatively connected to the lost motion device and to the operating cylinder shaft may be moved together between two extreme positions of movement and one of the devices may be moved to a intermediate position. The power cylinder assembly is relatively compact, and it may be readily coupled to the devices to which it is to impart movement.

In light of the above, it is therefore understood that within the scope of the appended claims, the invention may be practiced otherwise than as specifically described.

What is claimed is:

1. A three position power cylinder assembly, for effecting motion of objects through mechanical linkages, comprising:

an elongated power cylinder having a shoulder therein defined by the juncture of a smaller bore at one end and a larger diameter bore at the other end and having ports thereinto adjacent each end and adjacent said shoulder;

a shaft extending axially outwardly of both ends of said power cylinder and having a larger diameter portion in said smaller bore with a piston fixedly positioned thereon and sealing against the surface of said smaller bore;

a piston slidable on the smaller diameter portion of said shaft and closely sealing against the surface of said larger bore and said shaft;

resiliently compressible means for biasing said slidable piston towards said shoulder; and a lost motion device on the end of the power cylinder shaft projecting outwardly of the smaller bore end of said power cylinder, said device comprising a housing providing a chamber in which the end of said power cylinder shaft is slidably received, said lost motion device including resiliently compressible means in said chamber biasing said power cylinder shaft outwardly of said housing, whereby, when positioning elements are connected to said assembly on either side of said lost motion device, and (i) when pressurized fluid is supplied simultaneously to the port adjacent said shoulder and said large end port of said power cylinder, the power cylinder shaft is moved within said chamber of said lost motion device against the biasing pressure of said compressible means to move said lost motion device with said power cylinder shaft and thereby both associated positioning elements, and, (ii) when pressurized fluid is supplied to the ports at the ends of said power cylinder, said compressible means of said lost motion device biases said power cylinder shaft axially in said lost motion device in the direction of said larger bore and thereby moves only the associated positioning element connected to the said power cylinder shaft, and, (iii) when pressurized fluid is supplied only to said end port in said smaller bore, the slidable piston is moved axially by the shoulder of the power cylinder shaft against said biasing compressible means, and said power cylinder shaft is moved still further in the direction of said larger bore to effect full actuation of both positioning elements.

2. The power cylinder assembly in accordance with claim 1 wherein said resiliently compressible means comprise helical compression springs.

3. The power cylinder assembly in accordance with claim 2 wherein said lost motion device includes an axial stub post in the chamber of said housing against which an end of said power cylinder shaft selectively bears.

4. The power cylinder assembly in accordance with claim 3 wherein the end portion of said power cylinder shaft within said chamber has a collar spaced inwardly from said end portion, and the lost motion device spring has its ends seated around said stub post and the end of said power cylinder shaft and bearing against an end wall of said lost motion chamber and said collar.

5. The power cylinder assembly in accordance with claim 1 wherein said slidable piston has a washer on its face against which said shoulder of said power cylinder shaft abuts.

6. The power cylinder assembly in accordance with claim 2 wherein the end wall of said large diameter portion of said power cylinder has an annular boss and the opposing face of said slidable piston has a reduced diameter neck, and wherein the one of said helical springs has its end seated thereon.

7. The power cylinder assembly in accordance with claim 6 wherein sealing elements are provided in the end walls of said power cylinder about said power cylinder shaft.

8. A three position power cylinder assembly for effecting motion of objects through mechanical linkages comprising:

an elongated power cylinder having a shoulder therein defined by the juncture of a smaller bore at one end and a larger diameter bore at the other end and having ports thereinto adjacent each end and adjacent said shoulder;

a shaft extending axially outwardly of both ends of said power cylinder and having a larger diameter portion in said smaller bore with a piston fixedly positioned thereon and sealing against the surface of said smaller bore;

sealing elements in the end walls of said power cylinder about said power cylinder shaft;

a piston slidable on the smaller diameter portion of said shaft and closely sealing against the surface of said larger bore and said shaft;

a helical compression spring in said larger bore for biasing said slidable piston towards said shoulder; and a lost motion device on the end of said piston cylinder shaft projecting outwardly of the smaller bore end of said power cylinder, said device comprising a housing providing a chamber in which the end of said power cylinder shaft is slidably received, said housing having a shaft projecting axially from the end thereof opposite that receiving said end of said power cylinder shaft, said lost motion device including a helical compression spring in said chamber biasing said power cylinder shaft outwardly of said housing whereby, when positioning elements are connected to said assembly on either side of said lost motion device, and (i) when pressurized fluid is supplied simultaneously to the port in the large bore end and the port adjacent said shoulder of said power cylinder, the power cylinder shaft is moved within said chamber of said lost motion device against the biasing pressure of said lost motion spring to move said lost motion device with said power cylinder shaft and thereby both associated positioning elements, and, (ii) when pressurized fluid is supplied to the ports at the ends of said power cylinder, said spring of said lost motion device biases said power cylinder shaft axially in said power cylinder in said lost motion device in the direction of said larger bore and thereby moves only the associated positioning element connected to the power cylinder shaft, and, (iii) when pressurized fluid is supplied only to said port in said smaller bore, the slidable piston is moved axially by the shoulder of the power cylinder shaft and against its spring, and said power cylinder shaft is moved still further in the direction of said larger bore.

9. The power cylinder assembly in accordance with claim 8 wherein said lost motion device includes an axial stub post in the chamber of said housing against which the end of said power cylinder shaft selectively bears.

10. The power cylinder assembly in accordance with claim 9 wherein the end portion of said power cylinder shaft within said chamber has a collar spaced inwardly from its end, and the lost motion spring has its ends seated around said stub post and the end of said power cylinder shaft and bearing against said end wall of said housing and said collar.

11. The power cylinder assembly in accordance with claim 10 wherein the end wall of said large diameter bore portion of said power cylinder has an annular boss thereon and the opposing face of said slidable piston has a reduced diameter neck, and wherein the large bore helical spring has its ends seated around it.

* * * * *